United States Patent [19]

Wyatt

[11] 4,213,766

[45] Jul. 22, 1980

[54] METHOD AND MEANS FOR DISTRIBUTING GAS ALONG AN EXTENDED INLET PORTION OF GAS TREATMENT MEANS

[75] Inventor: John G. Wyatt, Birmingham, England

[73] Assignee: Lodge-Cottrell, Ltd., Birmingham, England

[21] Appl. No.: 932,723

[22] Filed: Aug. 10, 1978

[30] Foreign Application Priority Data

May 5, 1978 [GB] United Kingdom ..... 37108/77

[51] Int. Cl.[2] ..... B03C 3/36

[52] U.S. Cl. ..... 55/2; 55/129; 55/133; 55/344; 55/418; 422/176; 422/220; 138/37

[58] Field of Search ..... 55/2, 128, 129, 133, 55/344, 418, DIG. 37, 385 A; 98/40 VM; 138/37; 422/176, 220

[56] References Cited

U.S. PATENT DOCUMENTS

| | | | |
|---|---|---|---|
| 1,720,244 | 7/1929 | Smith | 138/37 |
| 1,941,287 | 12/1933 | Weiskopf | 55/418 |
| 2,348,518 | 5/1944 | Birkigt | 138/37 |
| 3,369,343 | 2/1968 | Robb | 55/385 A |
| 3,421,290 | 1/1969 | Cheney et al. | 55/385 A |
| 3,425,189 | 2/1969 | Haselmayer | 55/129 |
| 3,831,350 | 8/1974 | Gilles et al. | 55/128 |

FOREIGN PATENT DOCUMENTS

| | | | |
|---|---|---|---|
| 520710 | 2/1931 | Fed. Rep. of Germany | 55/129 |
| 532879 | 8/1931 | Fed. Rep. of Germany | 55/129 |
| 889248 | 7/1953 | Fed. Rep. of Germany | 55/128 |
| 1028062 | 5/1953 | France | 55/128 |
| 935795 | 9/1963 | United Kingdom | 55/418 |

*Primary Examiner*—David L. Lacey
*Attorney, Agent, or Firm*—Roy L. Van Winkle

[57] ABSTRACT

A gas conduit delivers gas to an electro-precipitator at an angle to the direction of gas flow through the precipitator. Projections are provided in the conduit adjacent the inlet to the precipitator to increase the thickness of the turbulent zone of the gas boundary layer; this urges gas towards upstream regions of the inlet of the precipitator, and thereby enhances even distribution of the gas across the inlet.

47 Claims, 4 Drawing Figures

16
34
28
38
30
24
12
14
19
26
35
20
15
17
22

METHOD AND MEANS FOR DISTRIBUTING GAS ALONG AN EXTENDED INLET PORTION OF GAS TREATMENT MEANS

Prior Application: Priority, Great Britain 6th Sept., 1977, Application No. 37108/77 (Provisional); Priority, Great Britain 5th May, 1978, Application No. 37108/77 (Complete).

This invention is concerned with improvements in or relating to gas treatment.

In various gas treatment operation, it is at times required to conduct gas to gas treatment means generally at an angle to the direction of gas flow through the gas treatment means. This may be for example because of space requirements or economy in materials of construction. In many such gas treatment operations it is important that the gas for the treatment should be fairly evenly distributed along an inlet portion of the gas treatment means so that the gas treatment operation can be carried out at optimum efficiency. However, in condunction the gas to the gas treatment means at an angle to the direction of gas flow through the gas treatment means, there is at times a tendency for the gas to bypass regions of the inlet portion of the gas treatment means which are upstream with respect to the gas flows towards the inlet portion.

It is an object of the present invention to provide an improved method of distributing gas along an extended inlet portion of gas treatment means, to which inlet portion the gas is conducted by a conduit which is at an angle to the direction of gas flow through the gas treatment means.

A particular but not exclusive example of a relevant gas treatment operation is a gas cleaning operation, e.g. by electro-precipitation, and gas distribution may be specially important with fine fumes, i.e. dirty particle-laden gases where the particle size is relatively fine. The dirty particle-laden gas to be cleaned is, for example, ventilated from a building, in which an industrial process is carried out, e.g. metallurgical processes such as oxygen steel-making, electric arc steel-making, non-ferrous production metallurgy, ferrous and non-ferrous foundries and cast houses. It will be realized that provision is usually made for collecting and cleaning dirty gas emanating directly from the industrial process in question, but there remains the problem of gas which escapes the primary collection system and has to be ventilated from the building, and it will be appreciated that this excaped gas will normally be considerably diluted by atmospheric air. For the description of a primary and secondary gas cleaninhg system, reference mat be made to the complete German Patent Specification No. 2745784 (Lodge-Cottrell).

Other gas cleaning applications include the final cleaning of gases from coal-fired power stations or cement plants, which have been subjected to a pre-cleaning operation to reduce the dust loading.

The invention provides a method of distributing gas flow along an extended inlet portion of gas treatment means, to which inlet portion gas for the treatment is conducted by a conduit which is at an angle to the direction of gas flow through the gas treatment means, a first conduit wall portion extending to a region of the inlet portion which is upstream with respect to gas flow along the conduit, and a second conduit wall portion extending at an acute angle to said direction of flow to a region of the inlet portion which is downstream with respect to gas flow along the conduit, and wherein spoiler means comprising a plurality of projections is provided on the second wall portion adjacent to the inlet portion.

The invention also provides a method of distributing gas flow along an extended inlet portion of gas treatment means, to which inlet portion gas for the treatment means, to which inlet portion gas for the treatment is conducted in turbulent flow by a conduit which is at an angle to the direction of gas flow through the gas treatment, a first conduit wall portion extending to a boundary of the inlet portion which is upstream with respect to gas flow along the conduit, and a second conduit wall portion extending at an acute angle to said direction of flow to a boundary of the inlet portion which is downstream with respect to gas flow along the conduit, and wherein spoiler means comprising a plurality of projections is provided on the second wall portion adjacent to the inlet portion and clustered towards the upstream boundary of the inlet portion.

The invention also provides a gas treatment process comprising the steps of distributing gas flow along an extended inlet portion of gas treatment means by a method according to the invention; and passing the gas from the inlet portion through the gas treatment means for the treatment therein.

The invention also provides gas treatment plant comprising (a) gas treatment means having an extended inlet portion, (b) a conduit arranged to conduct gas to the inlet portion and being at an angle to the direction of gas flow through the gas treatment means, a first conduit wall portion extending to a region of the inlet portion which is upstream with respect to gas flow along the conduit, and a second conduit wall portion extending at an acute angle to said direction of flow to a region of the inlet portion which is downstream with respect to the gas flow along the conduit, and (c) spoiler means comprising a plurality of projections on the second wall portion adjacent to the inlet portion, which projections are arranged to enhance even distribution of the gas flow across the inlet portion in the operation of the plant.

The invention also provides gas treatment plant comprising (a) gas treatment means having an extended inlet portion, (b) a conduit arranged to conduct gas to the inlet portion and being at an angle to the direction of gas flow through the gas treatment means, a first conduit wall portion extending to a boundary of the inlet portion which is upstream with respect to gas flow along the conduit, and a second conduit wall portion extending at an acute angle to said direction of flow to a boundary of the inlet portion which is downstream with respect to the gas flow along the conduit, and (c) spoiler means comprising a plurality of projections on the second wall portion adjacent to the inlet portion, and cluster towards the upstream boundary of the inlet portion, which projections are arranged to enhance even distribution of the gas flow across the inlet portion in the operation of the plant.

Preferably, there are 4 to 6 projections provided on the second wall portion.

Preferably each projection is triangular in cross-section with the base of the triangle lying on the second wall portion, more preferably each projection is in the shape of an equilaterally triangular.

The width of the extended inlet portion is, for example, 7.5 to 75 feet.

There now follows a description, to be read with reference to the accompanying drawings, of gas cleaning plant embodying the invention. This description, which is also illustrative of product, method and process aspects of the invention, is given by way of example only, and not by way of limitation of the invention.

The gas cleaning plant embodying the invention comprises an electro-precipitator 10, which in known manner comprises a plurality of spaced vertical collector electrodes 12 between which are located a plurality of rows of vertical discharge electrodes 14. In the operation of the precipitator 10, a dirty particle-laden gas to be cleaned flows generally horizontally through the precipitator 10; the discharge electrodes 14 are charged to a high voltage, the collector electrodes 12 being earthed, and corona discharge results, causing the particles from the gas to deposit on the collector electrodes 12 from which the deposited material is removed by the action of rapping gear (not shown) to fall into hoppers 13. The cleaned gas is then discharged to atmosphere. The precipitator 10 is generally squat in shape, being relatively wide and low. For example, the height of the collector electrodes 12 is 15 feet to 50 feet, the total width of the precipitator 10 (measured transverse to the direction of gas flow) is 30 feet to 300 feet, and the length of the precipitator in the direction of gas flow is 9 to 72 feet.

Figure 2:
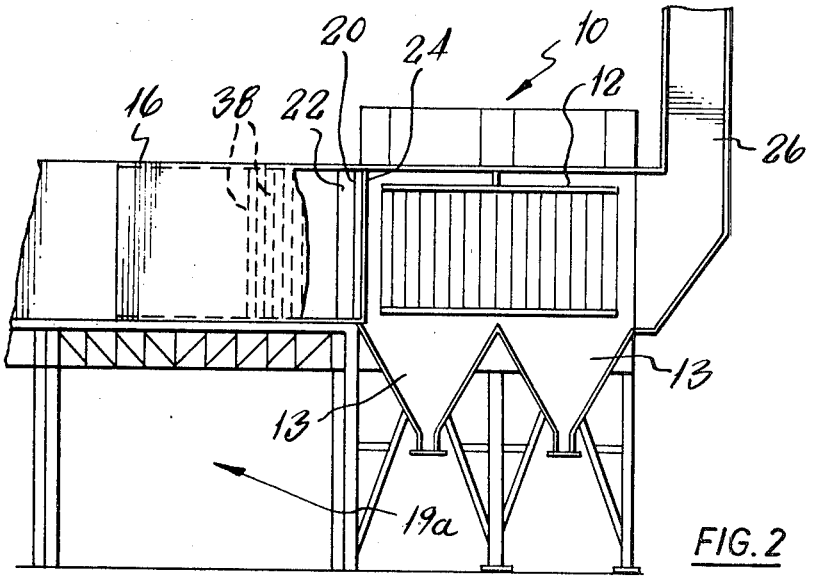
FIG. 2 shows a side view of the gas cleaning plant.

A horizontal conduit 16 of rectangular cross-section conducts the dirty solid particle-laden gas to be cleaned to the electro-precipitator 10; and the gas in the conduit 16 is, for example, air containing noxious fume being ventilated from a building **19*a* containing a steel-making converter from which the fume has escaped; the conduit 16 is mounted on the roof of the building and the precipitator 10 generally at the roof level on a separate structure (FIG. 2). The cross-sectional area of the conduit 16** is, for example, 100 to 1500 square feet.

The electro-precipitator 10 comprises side walls 19 and is divided into for example four separate equivalent transversely aligned precipitation units 15 by vertical dividing members 17, and each unit comprises a rectangular inlet portion 20 which extends vertically for the full height of the conduit 16; the inlet portion 20 is horizontally extended, and its width is substantially 25% of the total width of the precipitator 10. Each unit 15 comprises splitter means in the inlet portion 20, comprising a straight row of evenly spaced vertical planar splitter baffles 22 which are plane parallel to the direction of gas flow through the unit 15. The splitter means also comprises between the splitter baffles 22 and the collector electrodes 12, a straight tow of evenly spaced vertical circular cylindrical tubes 24; it will be realised that the circular cross section of the tubes 24 provides a nozzle to minimise local variations in gas velocity. The two rows 22, 24, are parallel to each other and at right angles to the direction of gas flow through the unit 15; and the baffles 22 and tubes 24 extend for substantially the full height of the inlet portion 20. There is a tube 24 aligned with each baffle 22; a tube 24 midway between each pair of baffles 22; a tube 24 midway between each partition 17 and adjacent baffle 22; and a tube 24 midway between each precipitator side wall 19 and adjacent baffles 22. In a modification the tubes are semi-cylindrical with the curved portions leading with respect to gas flow past the tubes. Each unit 15 comprises an upwardly directed outlet 26 for discharge of cleaned gas to the atmosphere.

Figure 1:
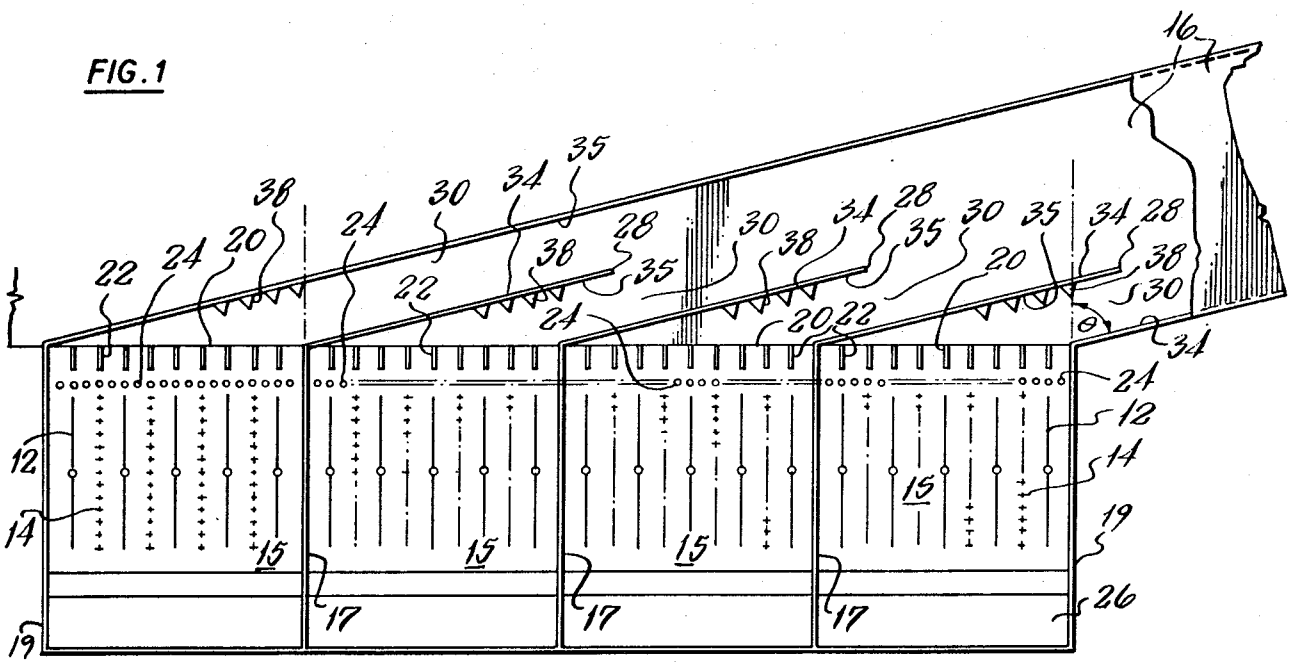
FIG. 1 shows a plan view of the gas cleaning plant embodying the invention.

The conduit 16 is inclined at an acute angle $\theta$ (FIG. 1) to the direction of gas flow through the units 15, and three parallel planar vertical baffles 28 are located in the conduit 16 for the full height of the conduit 16 to divide a downstream end portion of the conduit 16 into four separate parallel conduit portions 30, one for each unit 15. Each baffle 28 extends from a downstream boundary of an inlet portion 20 to a position somewhat upstream of the upstream boundary of the said inlet portion 20. Each baffle 28 is inclined at the acute angle $\theta$.

Opposed parallel conduit wall portion 34, 35, are provided either by an outer wall of the conduit 16 or by a baffle 28. In the case of each inlet portion 20 a first conduit wall portion 34 extends to the upstream boundary of the appropriate inlet portion 20, and a second conduit wall portion 35 extends to the downstream boundary of the inlet portion 20. Spoiler means comprising four projections 38 is provided on each second wall portion 35 adjacent the inlet portion 20 of the appropriate unit 15. Typically the projections (as viewed in FIG. 1) project 4% to 30% of the perpendicular distance (i.e. the minimum distance) between the wall portions 34, 35. The projections 38 are vertically extending members of equilateral triangular cross-section with the base of the triangle lying on the second wall portion 35; the projections 38 extend for the full height of the conduit 16; and are evenly spaced from each other along the wall portion 35, lying within the geometric projection (in plan view—FIG. 1) of the inlet portion 20 onto the wall portion 35. The projections are clustered towards the upstream boundary of the inlet portion 20, the projections commencing at the upstream end of said geometric projection and terminating at a position not more than 50% of the distance from said upstream end to the downstream boundary along the second wall portion.

In the operation of the plant, dirty particle-laden gas to be cleaned is conducted, in turbulent flow, along the conduit 16 to the electro-precipitator 10. The projections 38 serve to enhance even gas flow distribution horizontally across the inlet portion 20, and the baffles 22 and tubes 24 maintain relative consistency of gas distribution up to the collector electrodes 12.

The linear velocity of the gas in the conduit portions 30 is for example 20 to 80 feet/second.

We believe the projections 38 act by increasing the thickness of the turbulent zone of the gas boundary layer, which then urges gas towards upstream regions of the inlet portions 20.

The angle $\theta$ is, for example, at least 60°, more preferably 60° to 85°, e.g. about 80°.

In each unit 15, the spacing between each pair of adjacent collector electrodes 12 is for example 250 mm. to 700 mm., preferably 450 to 700 mm., or alternatively 250 mm. to 350 mm.

With the narrower collector electrode spacing, there is, for example, the same spacing between the splitter baffles 22 as between the collector electrodes 12, i.e. 250 mm. to 350 mm., but the splitter baffles 22 need not be aligned with the collector electrodes 12. With the wider collector electrode spacing, the spacing of the splitter baffles is, for example, half that of the collector electrodes 12, i.e. 225 mm. to 350 mm. but again the baffles 22 need not be aligned with the collector electrodes 12.

Figure 4:
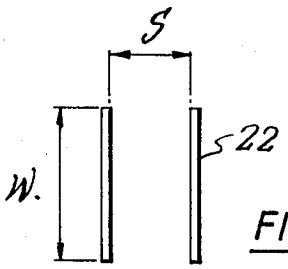
FIG. 4 is a diagram in plan view illustrating a numerical relationship between a splitter baffle dimension and spacing.

The spacing S (FIG. 4) between adjacent splitter baffles 22, may be related to their width w, which is uniform; S for example is not greater than 0.75 w, and preferably not more than 0.5 w.

The gas conducted along the conduit 16, has for example, a solid particle content not greater than 2000 mg/Nm$^3$, e.g. 80 to 1200 mg/Nm$^3$, and a solid particle size range, for example, of 0.1 to 10 microns. The gas leaving the precipitator 10 by the outlets 26 has, for example, a solid particle content not greater than 120 mg/Nm$^3$ or even less than 70 mg/Nm$^3$.

The temperature of the gas at the inlet portions 20 is, for example, not greater than 200° C., but with considerable variations up to that figure, e.g. from 10° C. upwards.

The total gas volume handled by the precipitator 10 is, for example, up to 2,500,000 M$^3$ per hour, and may be even higher. The gas pressures involved in the plant are not substantially in excess of atmospheric.

It will be realized that the plant embodying the invention may be incorporated in the apparatus described in the complete specification of our co-pending said German Patent Specification No. 2745784 (Lodge-Cottrell) for example the precipitator 10 and conduit 16 may replace the precipitator 38 and trunking 62 described in specification No. 2745784.

Figure 3:
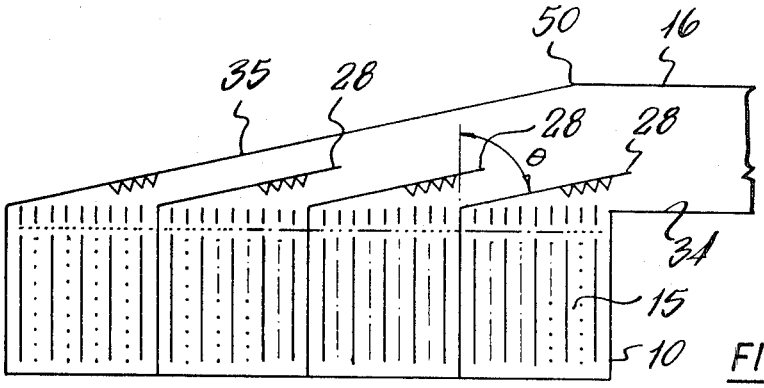
FIG. 3 shows a plan view of another version of gas cleaning plant embodying the invention.

FIG. 3 shows a version in which the conduit 16 leads towards the elctro-precipitator 10 at 90° to the direction of gas flow through the units 15. However, the conduit outer wall portion 35 and the baffles 28 are still inclined at angle $\theta$, the inclination of the wall portion 35 commencing at 50, just downstream of the upstream end of the upstream unit 15. It will be realized that in the case of the upstream unit 15, the first wall portion 34 is at an angle of 90° to the direction of gas flow through the precipitator 10.

I claim:

1. In a method of distributing gas flow along an extended inlet portion of gas treatment means, which inlet portion extends transversely to a longitudinal axis of the gas treatment means and to which inlet portion gas for the treatment is conducted in turbulent flow by a conduit which is at an angle to the longitudinal axis of the gas treatment means, wherein a first conduit wall portion extends to an upstream region of the inlet portion and a second conduit wall portion extends at an acute angle to said longitudinal axis to a downstream region of the inlet portion; the improvement wherein the thickness of the turbulent zone of the gas boundary layer on the second wall portion is increased so as to urge the gas towards the upstream region of the inlet by aerodynamic spoiler means comprising a plurality of projections provided on the second wall portion adjacent to the inlet portion.

2. The method according to claim 1, wherein there are about 4 to 6 projections provided on the second wall portion.

3. The method according to claim 1, wherein each projection is triangular in cross-section with the base of the triangular lying on the second wall portion, and each projection longitudinallfy extends transversely of said longitudinal axis.

4. The method according to claim 1, wherein the projections project about 4% to about 30% of the minimum distance between the first and second wall portions.

5. The method according to claim 1, wherein the projections lie within the geometric projection of the inlet portion onto the second wall portion in the direction of said longitudinal axis.

6. The method according to claim 1, wherein the projections are evenly spaced along the second wall portion.

7. The method according to claim 1, wherein said acute angle is at least about 60°.

8. The method according to claim 1, wherein said acute angle is about 60° to about 85°.

9. The method according to claim 1, wherein the first wall portion is parallel to the second wall portion.

10. The method according to claim 1, wherein gas flow splitter means is provided in the inlet portion.

11. The method according to claim 1, wherein the width of the inlet portion is about 7.5 to about 75 feet.

12. The method according to claim 1, wherein the linear velocity of the gas in the conduit is about 20 to about 80 feet per second.

13. The method according to claim 1, wherein the gas flows generally horizontally along the conduit and the projections extend vertically on the second wall portion.

14. The method according to claim 1, wherein the treatment is gas cleaning.

15. The method according to claim 14, wherein the gas for the treatment is a dirty solid particle-laden gas.

16. The method according to claim 1, wherein the treatment is electro-precipitation.

17. The method according to claim 1, wherein the gas has a solid particle content up to about 2000 mg/Nm$^3$.

18. The method according to claim 1, wherein the gas has a solid particle content of about 80 to about 1200 mg/Nm$^3$.

19. The method according to claim 1, wherein the gas contains solid particles of size range about 0.1 to about 10 microns.

20. In a method of distributing gas flow along an extended inlet portion of gas treatment means, which inlet portion extends transversely to a longitudinal axis of the gas treatment means and to which inlet portion gas for the treatment is conducted in turbulent flow by a conduit which is at an angle to the longitudinal axis of the gas treatment means, wherein a first conduit wall portion extends to an upstream boundary of the inlet portion and a second conduit wall portion extends at an acute angle to said longitudinal axis to a downstream boundary of the inlet portion; the improvement wherein the thickness of the turbulent zone of the gas boundary layer on the second wall poertion is increased so as to urge the gas towards the upstream region of the inlet by aerodynamic spoiler means comprising a plurality of projections provided on the second wall portion adjacent to the inlet portion and clustered towards the upstream boundary of the inlet portion.

21. The method according to claim 20, wherein the projections terminate at a position up to about 50% of the distance from their upstream boundary to the downstream boundary of the inlet portion.

22. Gas treatment plant comprising:

(a) gas treatment means having an extended inlet portion transverse to a longitudinal axis of the gas treatment means;

(b) conduit means for conducting gas to the inlet portion and being at an angle to the longitudinal axis of the gas treatment means, the conduit means having a first conduit wall portion extending to an upstream region of the inlet portion and a second conduit wall portion extending at an acute angle to said longitudinal axis and extending to a downstream region of the inlet portion; and (c) aerodynamic spoiler means on the second wall portion adjacent to the inlet portion for enhancing even distribution of the gas flow across the inlet portion, said spoiler means comprising a plurality of projections each having a substantial linear dimension transversely of said longitudinal axis.

23. Plant according to claim 22, wherein the projections terminate at a position up to about 50% of the distance from their upstream boundary to the downstream boundary of the inlet portion.

24. Plant according to claim 22, wherein there are about 4 to about 6 projections provided on the second wall portion.

25. Plant according to claim 22, wherein each projection is triangular in cross-section with the base of the triangle lying on the second wall portion, and each projection longitudinally extends transversely of said longitudinal axis.

26. Plant according to claim 22, wherein the projections project about 4% to about 30% of the minimum distance between the first and second wall portions.

27. Plant according to claim 22, wherein the projections lie within the geometric projection of the inlet portion onto the second wall portion in the direction of said longitudinal axis.

28. Plant according to claim 22, wherein the projections are evenly spaced along the second wall portion.

29. Plant according to claim 22, wherein said acute angle is at least about 60°.

30. Plant according to claim 22, wherein said acute angle is about 60° to about 85°.

31. Plant according to claim 22, wherein the first wall portion is parallel to the second wall portion.

32. Plant according to claim 22, wherein the width of the extended inlet portion is about 7.5 to about 75 feet.

33. Plant according to claim 22, wherein the flow of gas along the conduit is horizontal and the projections extend vertically on the second wall portion.

34. Plant according to claim 22, comprising gas flow splitter means in the inlet portion.

35. Plant according to claim 34, wherein the splitter means comprises a plurality of planar splitter baffles positioned in a plane parallel to said longitudinal axis, and a plurality of members downstream of the splitter baffles positioned and arranged to provide a nozzle effect.

36. Plant according to claim 35, wherein the splitter baffles are evenly spaced, the downstream members are evenly spaced, the spacing between the downstream members is about half that between the splitter baffles, and each baffle is aligned with a downstream member in the direction of said longitudinal axis.

37. Plant according to claim 35, wherein the splitter baffles are of about uniform width (w) in the direction of said longitudinal axis, and the spacing between adjacent splitter baffles is not greater than about 0.75 w.

38. Plant according to claim 35, wherein the downstream members are of a circular or semi-circular cross-section to provide the nozzle effect.

39. Plant according to claim 36, wherein the treatment means comprises an electro-precipitator comprising a plurality of spaced vertical collector electrodes and a plurality of discharge electrodes located between the collector electrodes.

40. Plant according to claim 39, wherein the spacing of the collector electrodes is about 450 mm. to about 700 mm. and the spacing of the splitter baffles is about 225 mm. to about 350 mm.

41. Plant according to claim 39, wherein the spacing of the collector electrodes is about 250 to about 350 mm. and the spacing of the splitter baffles is also about 250 mm. to about 350 mm.

42. Plant according to claim 39, wherein the height of the collector electrodes is about 15 to about 50 feet.

43. Plant according to claim 22, wherein the treatment means comprises gas cleaning means.

44. Plant according to claim 43, wherein the conduit communicates with the atmosphere in a building having means capable of producing noxious fumes which are liable to escape into the atmosphere in the building, and the conduit is arranged to ventilate air from the building through the gas treatment means.

45. Plant according to claim 44, wherein the gas treatment means is located generally at the roof level of the building.

46. Plant according to claim 22, comprising a plurality of transversely aligned adjacent inlet portions each having said first and second conduit wall portions extending thereto.

47. Gas treatment plant comprising:

(a) gas treatment means having an extended inlet portion transverse to a longitudinal axis of the gas treatment means;

(b) conduit means for conducting gas to the inlet portion and being at an angle to the longitudinal axis of the gas treatment means, the conduit means having a first conduit wall portion extending to an upstream boundary of the inlet portion and a second conduit wall portion extending at an acute angle to said longitudinal axis and extending to a downstream boundary of the inlet portion; and (c) aerodynamic spoiler means on the second wall portion adjacent to the inlet portion for enhancing even distribution of the gas flow across the inlet portion, said spoiler means comprising a plurality of projections clustered towards the upstream boundary of the inlet portion and each having a substantial linear dimension transversely of said longitudinal axis.

* * * * *